US005220345A

United States Patent [19]

Hirosawa

[11] Patent Number: 5,220,345

[45] Date of Patent: Jun. 15, 1993

[54] INK JET RECORDING APPARATUS

[75] Inventor: Toshiaki Hirosawa, Hiratsuka, Japan

[73] Assignee: Canon Kabushiki Kaisha, Tokyo, Japan

[21] Appl. No.: 767,541

[22] Filed: Sep. 27, 1991

Related U.S. Application Data

[63] Continuation of Ser. No. 500,873, Mar. 29, 1990, abandoned.

[30] Foreign Application Priority Data

Mar. 31, 1989 [JP] Japan ..... 1-82302
Mar. 26, 1990 [JP] Japan ..... 2-73216

[51] Int. Cl.[5] ..... B41J 2/195
[52] U.S. Cl. ..... 346/1.1; 346/140 R
[58] Field of Search ..... 346/140 R, 1.1

[56] References Cited

U.S. PATENT DOCUMENTS 4,459,469 7/1984 Ishima ..... 219/497
4,542,385 9/1985 Jinnai et al. ..... 346/75
4,719,472 1/1988 Arakawa ..... 346/140 R
4,791,435 12/1988 Smith et al. ..... 346/140 R
4,896,172 1/1990 Nozawa et al. ..... 346/140 R
4,947,194 8/1990 Kyoshima ..... 346/140 R
5,006,687 4/1991 Koizumi et al. ..... 346/140 R

FOREIGN PATENT DOCUMENTS 0317341 5/1989 European Pat. Off. .
56-044664 4/1981 Japan .
0193371 11/1982 Japan .
63-028651 2/1988 Japan .

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording apparatus includes a recording head having ink discharging portions for discharging ink and an ink chamber for supplying the ink to the discharging portions in accordance with discharging of the ink by the discharging portions, a plurality of ink supply ports for supplying ink to the ink chamber, ink supplying systems for supplying the ink through the ink supplying ports, a plurality of temperature detectors for detecting temperature of the recording head at different positions, and a controller, responsive to the temperature detectors for controlling supply of the ink through the ink supply ports and by the ink supplying systems.

14 Claims, 5 Drawing Sheets

INK JET RECORDING APPARATUS

This applications is a continuation of application Ser. No. 07/500,873 filed Mar. 29, 1990, now abandoned.

FIELD OF THE INVENTION AND RELATED ART

The present invention relates to an ink jet recording apparatus, and more particularly to an ink jet recording apparatus provided with a recording head having a chamber for containing ink to be ejected through an ejection outlet.

Known ink jet heads include a type of head wherein the liquid in the liquid passage is pressurized by deformation of a piezoelectric element, for example, to eject ink droplets, a type of head wherein a pair of electrodes is used so that the liquid droplet is electrostatically drawn off to be ejected by the electric field between the electrodes, and a type of head wherein a thermal energy generating element disposed in the liquid passage rapidly generates heat to produce a bubble in the ink liquid to eject a droplet of the ink. Among these types, the thermal energy using type can be said to be particularly advantageous in that a number of ejection outlets and thermal energy generating elements can be arranged at very high density without much difficulty, and also in that high speed recording is possible.

From another aspect, known recording heads contain a serial printing type wherein the recording operation is carried out while a recording head is moving in a predetermined direction relative to the recording material such as sheet of paper and a line type (full-line type) wherein a number of ejection outlets and ejection energy generating elements are disposed corresponding to the entire width of the recording material. From the standpoint of high speed printing, the line type is advantageous.

However, in the ink jet recording head of the conventional line type, when performing a high density image recording operation such as a solid image recording operation in which all of the heat generating elements are driven at once, or a high speed recording operation in which the heat generating elements are driven at high frequency (more heat generating elements are driven per unit time), not all of the heat generated by the heat generating elements are is carried off resulting in the carrying-over of the heat by the ejected ink or by heat transfer through various parts of the recording head. In addition, the recording head or the ink are heated by the heat generated by drivers for driving the heat generating elements. When the recording operation using the heat energy is carried out for a long period, the heat is accumulated in the recording head or the ink. As a result, a temperature gradient is produced in the ink in the common ink chamber. Referring to FIGS. 5 (A), (B) and (C), this will be described in more detail. In the case of the ink contained in the common chamber in the recording head shown in FIG. 5 (B), the temperature of the ink is highest adjacent to the center of the recording head because of to the heat accumulation during the recording operation in many cases. On the other hand, the temperature of the ink supplied from the supply pipe 8 is mostly influenced by the ambient temperature, and therefore, it is usually lower than the temperature of the ink in the head. These two factors result in the temperature gradient of the ink in the common chamber shown in FIG. 5, (C), for example. This causes the ink in the common liquid chamber to have a different viscosity, and in turn, the volume of the ink droplet discharged from the ejection outlets on the right side in the Figure is larger than that from the outlets on at the left side. Therefore, the recorded image has a non-uniform image density in the direction of the recording width S so that the right side has a higher density than the left side. Thus, the quality of the recorded image may be degraded.

This tendency becomes more remarkable with the increase in the number of ejection outlets (to 128 or to 256, for example). Particularly, in the case of the recording head of the line type wherein the ink is ejected with the bubble generated by the thermal energy, the number of ejection outlets provided may number several thousands, in which case the above problem will be further accentuated.

If the temperature gradient in the ink is so large that there exists a portion having a temperature higher than a predetermined level, the bubble formation process in the recording head in which the ink is ejected by the formation of the bubble using the thermal energy is degraded. In addition, the dissolved gases in the ink become easy to evaporate to obstruct the proper ink droplet formation.

SUMMARY OF THE INVENTION

Accordingly, it is a principal object of the present invention to provide an ink jet recording apparatus which is substantially free from the problem arising from the droplet volume change or the ink viscosity change attributable to the temperature gradient of the ink jet recording head of an ink jet recording type using the thermal energy, and/or the temperature gradient in the ink supplied in the recording head.

It is another object of the present invention to provide an ink jet recording apparatus which can provide substantially uniform image density over the entire width of the recording material in which one recording head carries out the recording at one time.

It is a further object of the present invention to provide an ink jet recording apparatus which can be properly operated at all times, and the image recording is always stabilized when the continuous recording operation is performed for a long period of time.

According to an aspect of the present invention, there is provided an ink jet recording apparatus, having: a recording head having ink discharging portions for discharging ink and an ink chamber for supplying the ink to the discharging portions in accordance with discharging of the ink by the discharging portions, a plurality of ink supply ports for supplying the ink to the ink chamber; ink supplying means for supplying the ink through the ink supplying ports, a plurality of temperature detecting means for detecting temperatures of the recording head at different positions, control means responsive to the temperature detecting means for controlling the supply of the ink through the ink supply ports and by the ink supplying means.

According to another aspect of the present invention, there is provided an ink jet recording apparatus, having: a recording head including heat generating elements for generating heat energy which causes the to discharge of ink, ink passages corresponding to the heat generating elements, and an ink chamber communicating with the ink passages, a plurality of supply pipes communicating with the ink chamber, a plurality of temperature sensors for detecting temperatures of the recording head at different positions, and control means responsive to said temperature sensors for selectively supplying the ink through the ink passages.

Further, the present invention provides an ink jet recording apparatus having a plurality of ink supply ports for supplying ink to the recording head, and proper supply port or ports are selected from the plural supply ports in accordance with the temperature distribution of the recording head, and the ink is supplied from the selected port or ports, whereby the temperature of the recording head is made more uniform, and in addition, the temperature of the recording head can be reduced.

In addition, the present invention provides an ink jet recording apparatus including a recording head provided with ejection outlets for ejecting ink and an ink chamber for supplying the ink toward the ejection outlet in accordance with the ejection of the ink therethrough, a plurality of ink supply ports for supplying the ink to the ink chamber, ink supply means for supplying the ink through the ink supply ports, a plurality of temperature detecting means for detecting temperature of the recording head at plural different positions, and control means for controlling the quantity of the ink supplied from the plural ink supply ports by the supply means in accordance with the temperature detected by the temperature detecting means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In the ink jet recording apparatus according to this embodiment, the temperature of the recording heads is detected at different positions. If the temperature distribution at different points on the recording head varies beyond a predetermined level, a proper supply port is selected from plural ink supply ports for supplying ink to the recording head in consideration of the detected non-uniformity, and the ink is supplied through the supply port. By doing so, the recording head is cooled by the supplied ink, and therefore, the temperature of the entire recording head is made uniform.

The embodiment of the present invention will now be described in conjunction with the drawings.

Figure 1A:
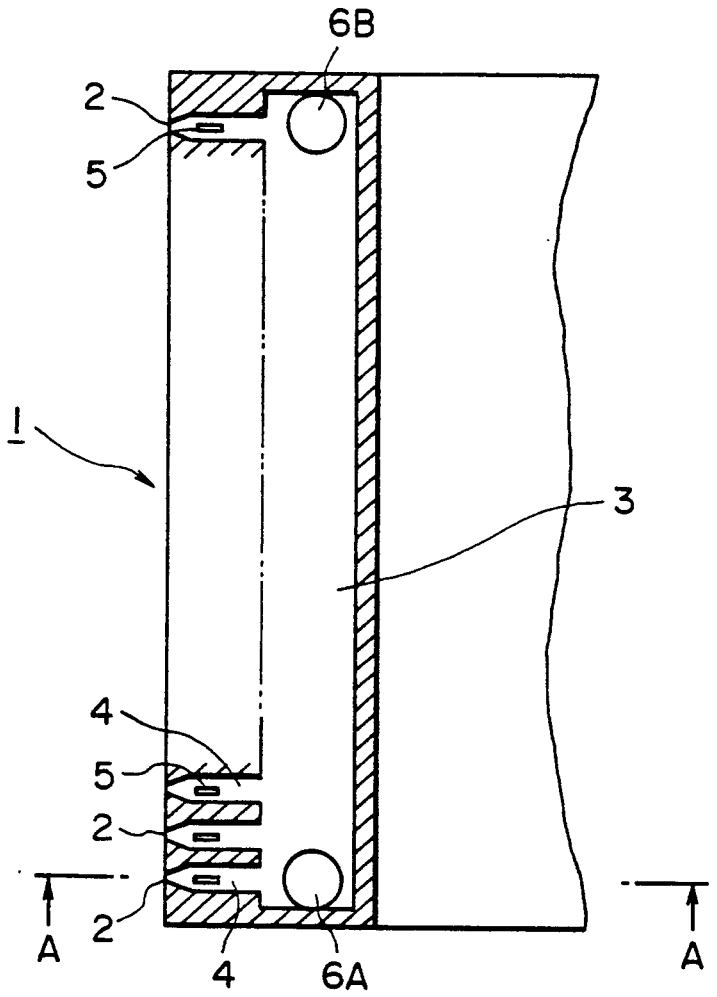
FIG. 1A is a somewhat schematic top sectional view of an ink jet recording head according to an embodiment of the present invention.
Figure 1B:
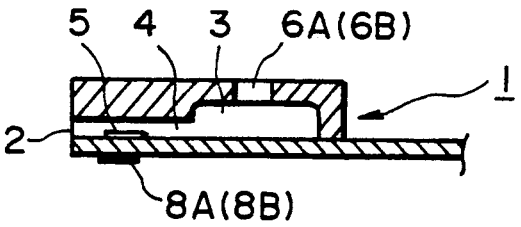
FIG. 1B is a side sectional view of the same.

Referring to FIGS. 1A and 1B, there is shown an ink jet recording head used with the ink jet recording apparatus according to an embodiment of the present invention. A recording head 1 is of the line type wherein a number of ejection outlets which will hereinafter be called "orifices" are provided in positions corresponding to the width of the recording material. During the recording operation, a relative movement is imparted between the recording head 1 and the recording material, and the ink is selectively ejected through the orifices 2 to the recording material. The recording head comprises a common ink chamber and ink passages 4 each communicating with the respective orifices 2 from the common chamber. As shown in FIG. 1A, the ink passages 4 disposed at regular intervals are provided with respective heat generating elements 5. In the case where an electrothermal transducer element is used as the heat generating elements 5, each of the heat generating elements 5 includes a heat generating resistor layer and at least a pair of electrodes electrically connected therewith. In order to protect the heat generating elements from the ink or the like, the heat generating resistor layer and/or the electrodes may be coated with protection layers, if necessary.

The recording head further includes a first supply port 6A for supplying ink to the common ink chamber 3 and a second supply port 6B for supplying the ink from an ink container which will be described hereinafter when the ink is supplied to the common ink chamber 3 or when the ink is circulated. Temperature sensors **8*a* and 8*b* are mounted on the backside of the ink passages 4 of the recording head (the side opposite from the heat generating element 5 through the substrate), as shown in FIG. 1B, at or adjacent the opposite longitudinal ends of the array of the orifices 2**.

Figure 2:
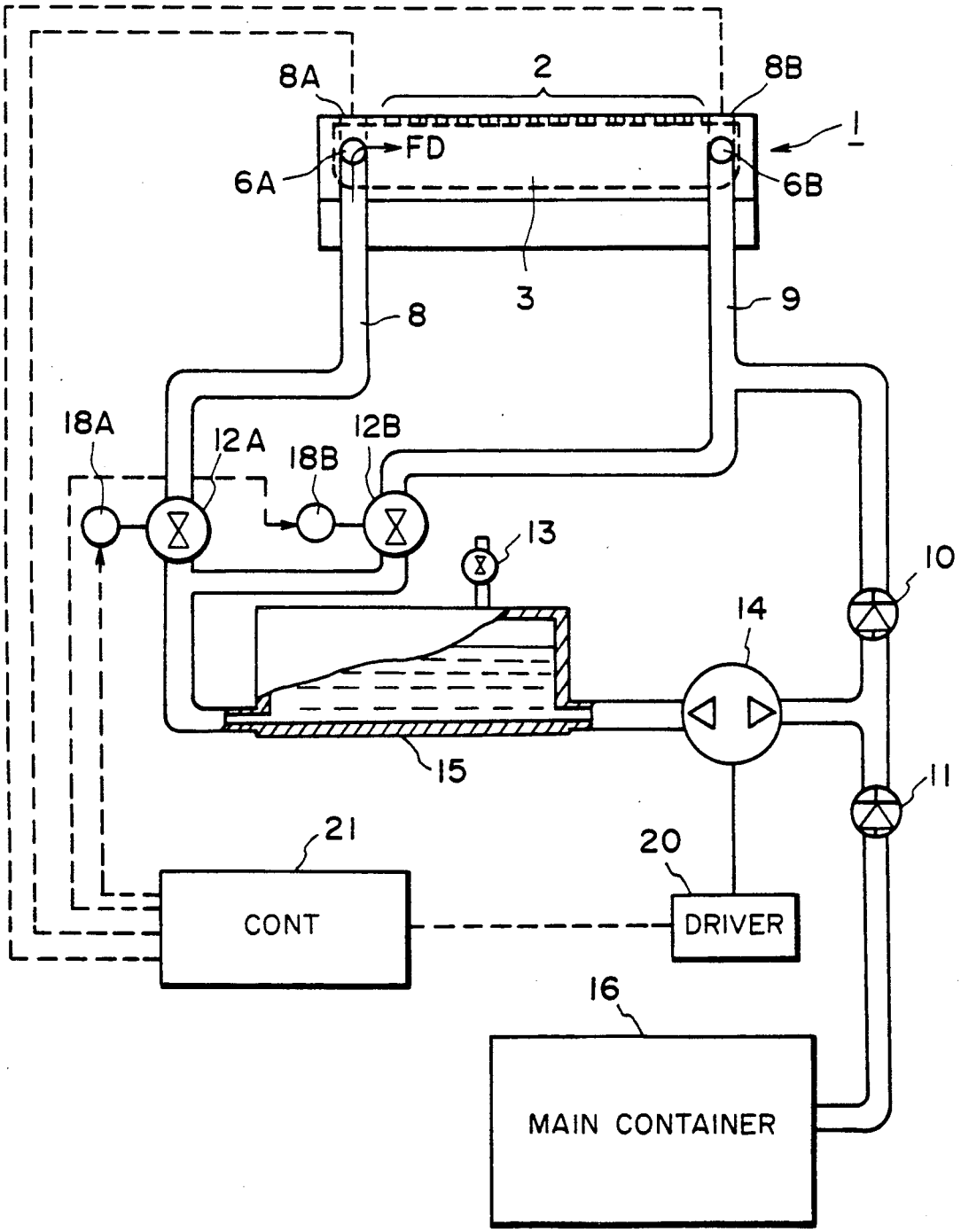
FIG. 2 is a block diagram of an ink supply system and a control system therefor for supplying ink to the recording head shown in FIG. 1.

FIG. 2 is a block diagram illustrating the ink supply system and the circulation system for the recording head 1. The system includes a supply pipe 8 for supplying the ink from the ink supply container 15 through the supply port 6A to the recording head during the recording operation, a second supply pipe 10 for supplying the ink to the common ink chamber 3 of the recording head 1 through the supply port 6B during the recording and circulating operations, and shut-off valves in the form of solenoid valves 12A and 12B provided in the supply pipes 8 and 9, respectively. The supply container 15 is provided with an air vent valve 13. A pump 14 is driven by a driver 20. The solenoid valves 12A and 12B are operated by switching elements 18A and 18B for energizing or deenergizing the solenoid valves. A control circuit 21 is responsive to the temperature detection signals of the temperature sensors 8A and 8B to control the solenoid valves 12A and 12B and the pump 14, which will be described in more detail hereinafter. The control circuit 21 has memory means for storing the program for carring out the control steps which will be described below in conjunction with FIG. 3.

Figure 3:
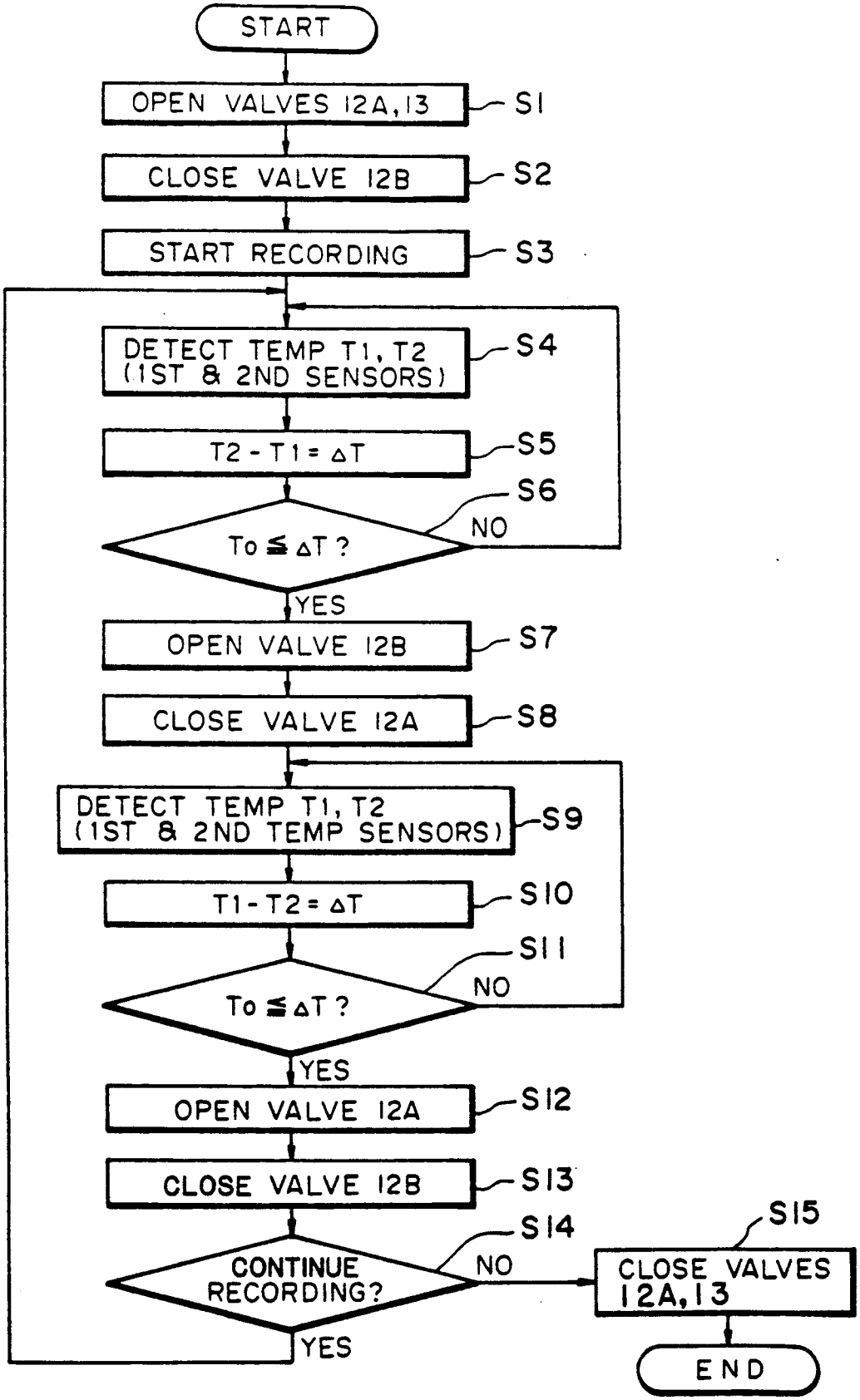
FIG. 3 is a flow chart showing the control process for the ink supply system shown in FIG. 2.

Referring to FIG. 3, the control operation of the apparatus according to an embodiment of the present invention will be described.

When the recording operation is performed, the solenoid valve 12A is opened at step S1, and the air vent valve 13 is opened. At step S2, the solenoid valve 12B is closed. Thereafter, that is, at step S3, the recording head is driven to start the recording operation. At step S4, the temperature T1 adjacent the first supply port 6A is detected by the temperature sensor 8A and the temperature T2 adjacent to the second supply port 6B is detected by the temperature sensor 8B.

At step S5, a difference ΔT between the temperatures T1 and T2 is obtained. At step S6, the discrimination is made as to whether the temperature difference ΔT is beyond the upper limit To or not. If not, the steps S4–S6 are repeatedly executed, and the temperature difference is monitored until the upper limit temperature To is reached. If the discrimination indicates that the temperature difference reaches the upper limit temperature To, that is, the temperature T2 adjacent to the supply port 6B is higher than the temperature T1 adjacent to the supply port 6A by at least a predetermined difference level, the solenoid valve 12B associated with the supply port 6B is opened at step S7, and the solenoid valve 12A associated with the supply port 6A is closed at step S8.

At step S9, the temperatures T1 and T2 are detected again. At step S10, the temperature difference ΔT which is reverse of the difference at the step S5 that is, T1–T2 is obtained. Then, the discrimination is made as to whether or not the temperature difference ΔT reaches the upper limit To or not. If not, the temperature is monitored until the upper limit temperature To is reached, similarly to the above-described step. When the discrimination indicates that the upper limit temperature To is reached, the solenoid valve 12A is opened at step S12, and the solenoid valve 12B is closed at step S13.

At step S14, the discrimination is made as to whether the recording operation will be continued or not. If so, the step S4 is executed, and if not, the solenoid valve 12A and the air vent valve 13 of the container 15 are closed at step S15.

By the control process described above, relatively cool ink is supplied to the portion of the head where the ink temperature is high, so that the high temperature portion of the recording head is decreased, and therefore, the temperature distribution of the recording head can be made uniform.

When an ejection recovery operation is carried out, although not shown in the Figure, the solenoid valves 12A and 12B are closed, and the circulating valve 10 is opened. Then, the pump 14 is driven to eject idly the ink through the orifice 2.

Figure 4:
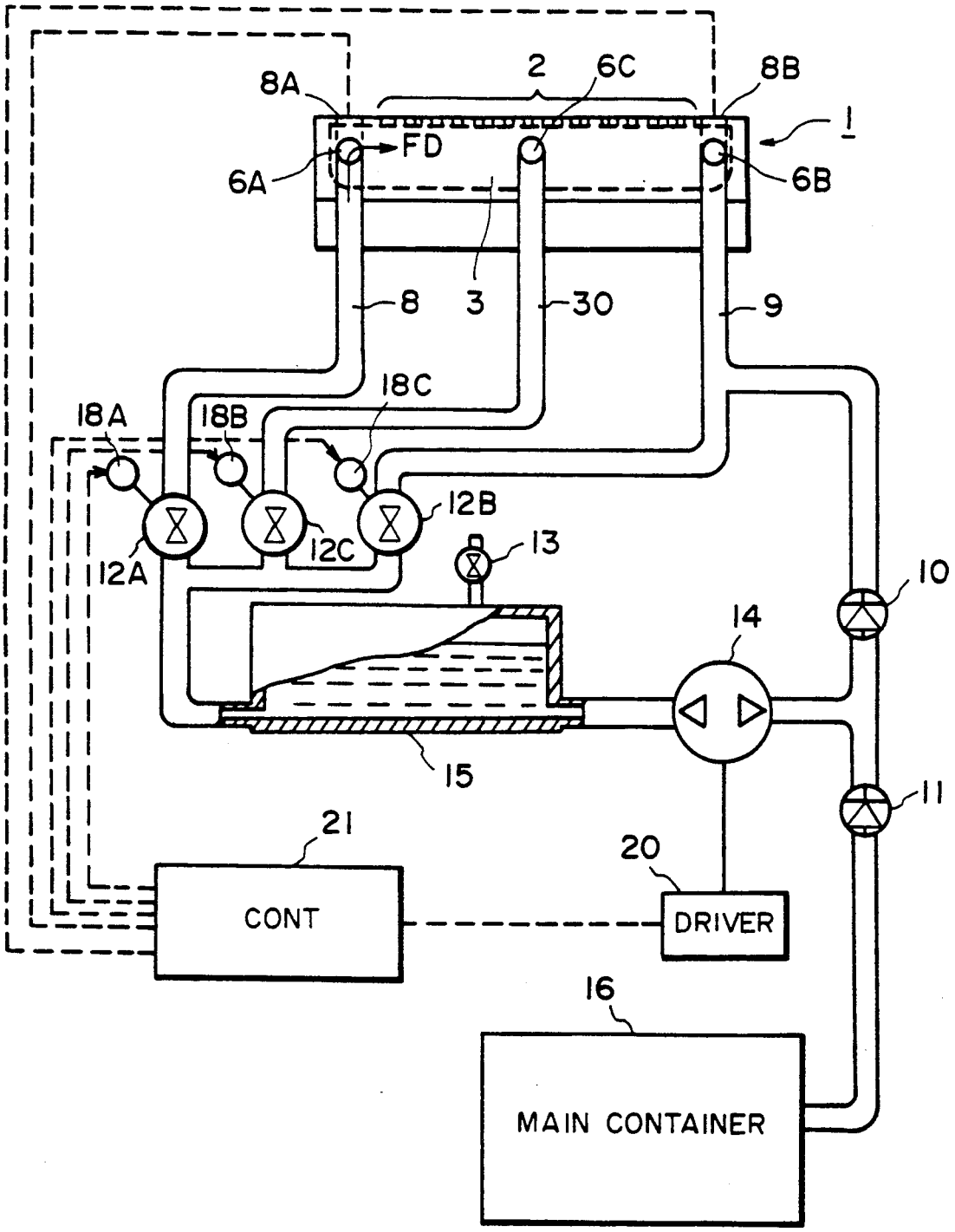
FIG. 4 is a block diagram illustrating an ink supply system and a control system therefor according to another embodiment of the present invention.
Figure 5A:
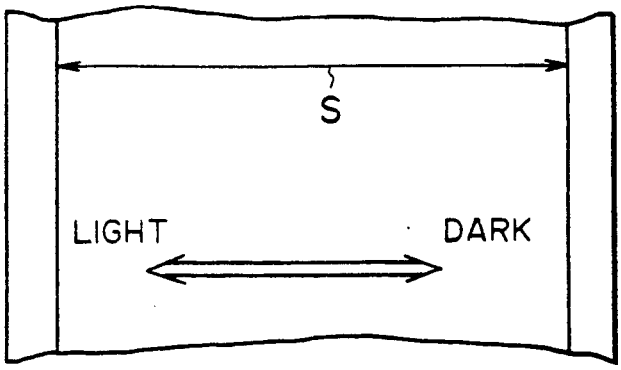
FIG. 5(A) PRIOR ART
FIGS. 5A–C show a schematic top plan view of a recording material, a somewhat schematic top plan view of the recording head and a temperature distribution, illustrating a relationship between the ink temperature distribution in a common chamber and the image record density in a conventional recording head.
Figure 5B:
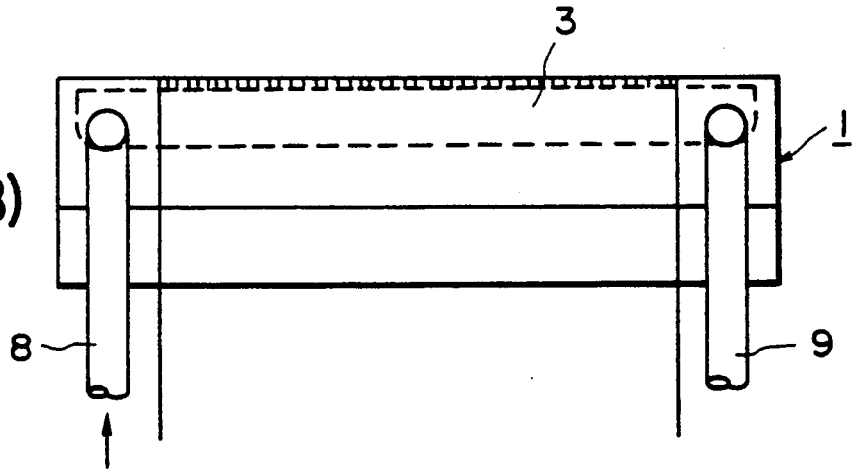
FIG. 5(B) PRIOR ART
Figure 5C:
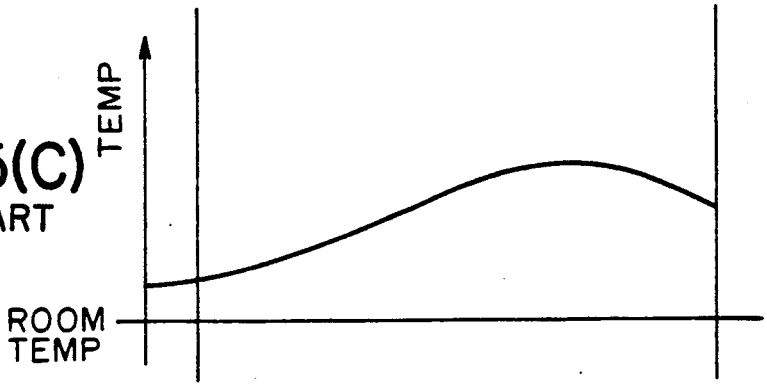
FIG. 5(C) PRIOR ART

Referring to FIG. 4, a recording head and ink supply system for supplying ink to the recording head according to another embodiment of the present invention will be described. In this embodiment, in addition to the ink supply ports 6A and 6B at or adjacent the longitudinal end of the recording head, an additional ink supply port 6c is provided at the center together with an additional supply pipe 30 and solenoid valve 12C.

The variation of the ink supply port selection may be increased, so that the control operation can be effected with finer steps against the temperature distribution of the recording head.

In addition, by increasing the number of temperature sensors mounted on the recording head, the temperature distribution can be detected more accurately, so that the finer control is possible.

For example, as shown in FIG. 4, the temperature sensors 8A, 8B, 8C (8C is not shown) are mounted corresponding to the supply ports 6A, 6B and 6C, respectively. On the basis of the temperatures detected by the temperature sensors, the ink supplies through the supply ports 6A, 6B and 6C can be controlled.

The following is an example of such control. Normally, the solenoid valve 12C associated with the supply port 6C is opened, and the solenoid valves 12A and 12B associated with the other supply ports 6A and 6B are closed. Then, the comparison is made between the temperatures detected by the temperature sensors 8A and 8B and the temperature detected by the temperature sensor 8C. When the temperature difference exceeds the desired temperature difference, the corresponding solenoid valve or valves are opened, and the solenoid valve 12C is closed. By doing so, low temperature ink is supplied causing the ink temperature in the head to quickly become uniform.

In the foregoing, the solenoid valves in the supply pipes are on-off-controlled. If the upper limit of the temperature difference To is desired to be decreased in order to further increase the image quality, flow control valves are used in place of the solenoid valves 12A and 12B, so that the amounts of the ink supplied to the supply pipes can be more finely controlled. In this case, the control steps are the same as shown in FIG. 3, but the flow rate is controlled in accordance with the temperature detection in place of the on-off-control of the valves.

The recording heads described in the foregoing embodiments are particularly effective when the ink is ejected using the heat generating element, but the present invention is not limited to such types, but is applicable to the case where the ejection energy is provided by piezoelectric elements or the like.

As described in the foregoing, according to the present invention, the temperature of the recording head is detected at different positions, and if the temperature distribution in the recording head is uneven, more particularly, the variation exceeding a tolerable limit, the ink is supplied from a selected one or ones of plural supply ports to the recording head, by which the temperature of the recording head can be reduced by the ink thus supplied, and the temperature distribution of the entire recording head can be made more uniform. Therefore, variations in the size of the ink droplet ejected can be suppressed, and therefore, to differences in the recording density on the recording medium can be avoided. By controlling the amount of ink supply through the plural ink supply ports, further improved recording is possible. The present invention is particularly suitable for the line type recording head.

Furthermore, according to the present invention, stabilized recording is always possible even when continuous recording operations are carried out for a long period of time, in addition, to the advantage that high speed recording operation is possible.

While the invention has been described with reference to the structures disclosed herein, it is not confined to the details set forth and this application is intended to cover such modifications or changes as may come within the purposes of the improvements or the scope of the following claims.

I claim:

1. An ink jet recording apparatus, comprising:

a recording head having ink discharging portions for discharging an ink and an ink chamber for supplying the ink to the discharging portions in accordance with discharging of the ink by the discharging portions;

a first and a second ink supply port for supplying the ink to said ink chamber;

ink supplying means for supplying the ink to said ink supply ports;

a first and a second temperature detecting means for detecting temperatures of said recording head at different positions; and control means, responsive to said temperature detecting means, for controlling said ink supplying means to provide ink to whichever one of said first and said second supply ports is closer to whichever one of said first and said second temperature detecting means that detects a higher temperature, whenever a difference between the temperatures detected by said first and said second temperature detecting means is greater than a predetermined level.

2. An apparatus according to claim 1, wherein the supply of the ink through each of said ink supply ports is changed continuously in response to said temperature detecting means.

3. An apparatus according to claim 1, wherein each of said discharging portions includes an ink discharging outlet, an ink passage communicating with the ink discharging outlet and with said ink chamber and a heat generating element disposed in the ink passage.

4. An apparatus according to claim 1, wherein said discharging portions are arranged corresponding to a width of a recording material which is faced to the discharging portions.

5. An apparatus according to claim 1, wherein the supply of the ink is controlled by a valve provided in said ink supplying means.

6. An apparatus according to claim 5, wherein said valve is in the form of a solenoid valve.

7. An apparatus according to claim 1, wherein said ink supplying means includes a pump for supplying the ink and/or circulating the ink.

8. An apparatus according to claim 1, further comprising memory means for storing a plurality of temperature control steps to be carried out by said control means.

9. An ink jet recording apparatus, comprising:

a recording head including a plurality of heat generating elements for generating heat energy contributable to discharge an ink, a plurality of ink passages corresponding to the heat generating elements, and an ink chamber communicating with the ink passages;

a first and a second ink supply pipe communicating with the ink chamber, the ink being supplied to said recording head through one of said first and said second ink supply pipes;

a first and a second temperature sensor for detecting a temperature of said recording head at different positions;

ink supply means for supplying the ink to said recording head; and control means, responsive to said first and said second temperature sensor, for controlling said supply means to provide the ink to whichever one of said first and said second supply pipes is closer to whichever one of said first and said second temperature sensor detects a higher temperature, when a difference between temperatures detected by said first and said second temperature sensor is greater than a predetermined level.

10. An apparatus according to claim 9, further comprising valves associated with said ink supply pipes.

11. An apparatus according to claim 10, wherein the valves are solenoid valves.

12. An apparatus according to claim 9, wherein said control means controls valves associated with said ink supply pipes.

13. An ink jet recording method comprising the steps of:

providing a recording head having ink discharging portions arranged in a predetermined direction for discharging an ink, heat generating means for respective ink discharging portions, a common ink chamber for supplying the ink to the ink discharging portions, and first and second ink supply ports spaced from each other along the predetermined direction for supplying the ink to the ink chamber;

detecting a temperature difference between first and second regions of the recording head along the predetermined direction; and supplying ink through the ink supply port closer to the region having a higher temperature when the temperature difference is greater than a predetermined level.

14. An ink jet recording apparatus comprising:

a recording head having ink discharging portions for discharging an ink and an ink chamber for supplying the ink to the discharging portions in accordance with discharging of the ink by the discharging portions;

a first and a second ink supply port for supplying the ink to said ink chamber;

ink supplying means for supplying the ink to said ink supply ports;

temperature detecting means for detecting a difference in a temperature of said recording head between a first position closer to said first ink supply port and a second position closer to said second port; and control means, responsive to said temperature detecting means, for controlling said ink supplying means to provide ink to whichever one of said first and second ink supply ports is closer to the position at which said temperature detecting means detects a higher temperature, whenever the difference detected by said temperature detecting means is greater than a predetermined level.

* * * * *

UNITED STATES PATENT AND TRADEMARK OFFICE

CERTIFICATE OF CORRECTION

PATENT NO. : 5,220,345

DATED : June 15, 1993

INVENTOR(S) : TOSHIAKI HIROSAWA

It is certified that error appears in the above-identified patent and that said Letters Patent is hereby corrected as shown below:

On title page,

IN [56] REFERENCES CITED

Under U.S. PATENT DOCUMENTS:
"5,006,687 4/1991 Koizumi et al." should read
--5,006,867 4/1991 Koizumi et al.--.

COLUMN 1

Line 4, "applications" should read --application--.
Line 33, "as" should read --as a--.
Line 47, "are" should be deleted.
Line 50, "are" should read --is--.
Line 61, "to" should be deleted.

COLUMN 2

Line 4, "at" should be deleted.
Line 47, "apparatus, having:" should read --apparatus having--.
Line 53, "chamber;" should read --chamber,--.
Line 61, "apparatus, having:" should read --apparatus having--.
Line 63, "to" should be deleted.

COLUMN 3

Line 57, "heads" should read --head--.

COLUMN 6

Line 40, "to" should be deleted.

UNITED STATES PATENT AND TRADEMARK OFFICE

CERTIFICATE OF CORRECTION

PATENT NO. : 5,220,345

DATED : June 15, 1993

INVENTOR(S) : TOSHIAKI HIROSAWA

It is certified that error appears in the above-identified patent and that said Letters Patent is hereby corrected as shown below:

COLUMN 8

Line 4, "sensor" should read --sensor that--.

Signed and Sealed this

Twelfth Day of April, 1994

Bruce Lehman

*Attest:*

BRUCE LEHMAN

*Commissioner of Patents and Trademarks*

*Attesting Officer*